US006737813B2

(12) United States Patent
Kawasaki et al.

(10) Patent No.: US 6,737,813 B2
(45) Date of Patent: May 18, 2004

(54) EL ELEMENT DRIVE CIRCUIT AND DISPLAY PANEL

(75) Inventors: Somei Kawasaki, Saitama (JP); Masanobu Oomura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/423,005

(22) Filed: Apr. 25, 2003

(65) Prior Publication Data

US 2003/0209990 A1 Nov. 13, 2003

(30) Foreign Application Priority Data

May 8, 2002 (JP) ..... 2002-132287

(51) Int. Cl.[7] ..... G09G 3/10; G09G 3/30

(52) U.S. Cl. ..... 315/169.3; 345/76; 345/77; 345/55

(58) Field of Search ..... 315/169.3, 169.4, 315/169.1; 345/76, 77, 55, 60, 63

(56) References Cited

FOREIGN PATENT DOCUMENTS

JP 2001-191135 * 6/2001

* cited by examiner

*Primary Examiner*—Tuyet T. Vo

(74) *Attorney, Agent, or Firm*—Fitzpatrick, Cella, Harper & Scinto

(57) ABSTRACT

A high quality display panel using EL elements in which a limitation of drive circuit layout can be minimized while influences of variations in characteristics of circuit elements to be used and light emission operating errors (variations) of the EL elements which result from mixing of a noise into a signal supply line for supplying an image signal are reduced. A current setting system is employed as a drive system. A transistor having a large dynamic resistance characteristic with respect to a minute current is inserted between a voltage setting transistor for determining an injection current into the EL elements and a power source, thereby suppressing a variation in voltage between terminals of a capacitor which results from a noise mixed from the signal supply line.

4 Claims, 10 Drawing Sheets t0
t1
t2
Id(n-1)
Id(n)
Id(n+1)
Video
P1
P2
M1/G
M1/S
VCC
#1
#2
Vd#(n)
Vd(n)
Vd%(n)
ΔVd
N1
N2

FIG. 10A
PRIOR ART
FIG. 10B
PRIOR ART
FIG. 10C
PRIOR ART
FIG. 10D
PRIOR ART
FIG. 10E
PRIOR ART
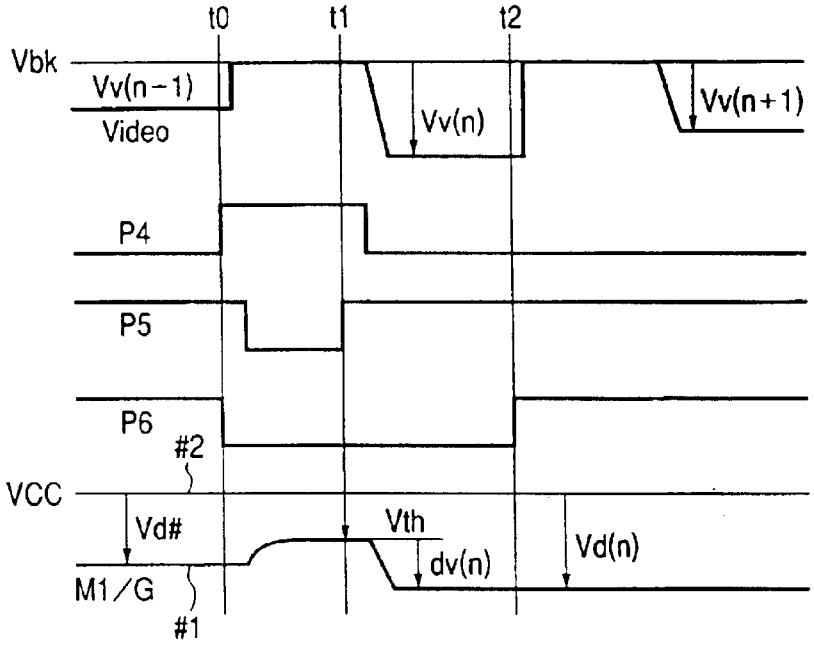
FIG. 11
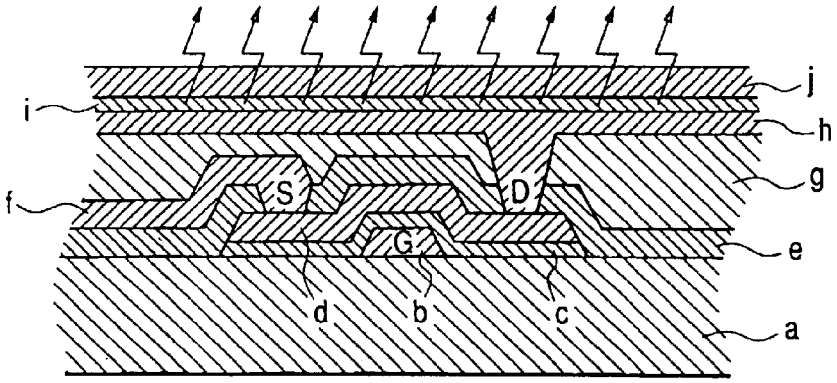

EL ELEMENT DRIVE CIRCUIT AND DISPLAY PANEL

BACKGROUND OF THE INVENTION

1. Field of the Invention

The present invention relates to a circuit for driving an electroluminescence element which emits light by injecting a current thereinto.

2. Related Background Art

An electroluminescence element (hereinafter referred to as an EL element) is applied to a display panel type image display system in which a plurality of pixel display circuits including the EL elements are arranged in matrix (hereinafter referred to as a display panel), and the like. In general, the display panel has a large area, so that it cannot be formed on a single crystalline silicon substrate. Thus, the display panel is produced by a process of forming thin film transistors (TFTs) on a glass substrate.

For the EL element drive circuit, there are mainly two kinds of systems, a voltage setting system and a current setting system.

(Voltage Setting System)

First, a voltage setting system will be described using FIG. 9. FIG. 9 is a circuit diagram of a general pixel display circuit using the voltage setting system.

A signal supply line Video for inputting an image signal is connected with a source electrode (M15/S) of a MOS transistor M15 (MOS transistor is indicated by an abbreviation of M in this specification) whose gate electrode is controlled according to a control pulse P6 (in this specification, the source electrode, the drain electrode, and the gate electrode of the MOS transistor are indicated by abbreviations of /S, /D, and /G, respectively) The drain electrode of M15 (M15/D) is connected with one end of a capacitor C2. The other end of the capacitor C2 is connected with a capacitor C1 whose end is connected with a power source VCC, the gate electrode of M1 (M1/G) whose source electrode is connected with the power source VCC, and M17/S whose gate electrode is controlled according to a control pulse P5. M1/D and M17/D are connected with M16/S whose gate electrode is controlled according to a control pulse P4. M16/D is connected with a current injection terminal of an EL element. The other terminal of the EL element is connected with a ground GND.

A large number of pixel display circuits 1 are arranged in a display panel. In the case of, for example, QVGA (320×240), the signal supply line Video is led to and connected with 240 pixel display circuits 1. The control pulses P4 to P6 are led to and connected with 320 pixel display circuits 1.

The operation of the pixel display circuit 1 shown in FIG. 9 will be described using time charts in FIGS. 10A to 10E. FIGS. 10A to 10E are voltage state charts with respect to the signal supply line Video, the control pulse P4, the control pulse P5, the control pulse P6, and M1/G, respectively.

(Before Time t0)

A voltage on the signal supply line Video is a signal level Vv(n−1) for light emission setting of the pixel display circuits 1 located on a preceding line. Because P4=L, P5=H, and P6=H, M15 is in an OFF state, M16 is in an ON state, and M17 is in an OFF state. Thus, a voltage of M1/G is kept to a voltage Vd# charged in the capacitor C1 by previously controlling the corresponding pixel display circuit 1. A current determined according to the voltage Vd# is injected into the EL element, so that EL element emits light.

(At Time t0)

P4 becomes H and P6 becomes L. Thus, M15 becomes an ON state and M16 becomes an OFF state. Subsequently, the signal supply line Video is set to a black level Vbk (maximum voltage). Subsequently, P5 is set to L, so that M17 is turned ON. At this time, M1 becomes a self discharge state. Thus, the capacitor C1 is discharged, so that a voltage of M1/G is increased.

Now, a current-voltage characteristic of a MOS transistor can be substantially indicated by a pentode characteristic of the equation (1):

$$\left.\begin{aligned} Ids &= k \times \Delta V \\ \Delta V &= Vgs - Vth \end{aligned}\right] \tag{1}$$

where symbol Ids denotes a drain current, k denotes a drive coefficient, Vgs denotes a gate-source voltage, and Vth denotes a threshold voltage.

As can be understood from the equation (1), when Vgs approaches Vth, Ids becomes smaller. Thus, the self discharging operation of M1 becomes weaker. Therefore, as shown in FIG. 10E, the voltage of M1/G asymptotically approaches Vth. Further, the capacitor C2 is discharged such that a voltage between terminals becomes (Vcc−Vth−Vbk).

(At Time t1)

Because P5 becomes H, M17 becomes an OFF state. Subsequently, because P4 becomes L, M16 becomes an ON state. Subsequently, the voltage on the signal supply line Video is reduced to a desirable level Vv(n), so that the voltage of M1/G is reduced by a voltage dv(n) indicated by the equation (2).

$$dv(n)=[C2\div(C1+C2)]\times Vv(n) \tag{2}$$

In the equation (2), symbols C1 and C2 denote electric capacitances of the capacitors C1 and C2.

The voltage dv(n) is basically independent on a transition speed of Vv(n). The voltage dv(n) corresponds to ΔV in the equation (1). Thus, a current is injected into the EL element through the transistor M1.

(At Time t2)

Because P6 becomes H, M15 becomes an OFF state. Subsequently, a current is injected into the EL element through the transistor M1, so that light emitting operation is continued until the next light emission setting operation. After the time t2, the same light emission setting operation is conducted for the pixel display circuits 1 located on the next row.

In the light emission setting operation of the pixel display circuit 1 shown in FIG. 9 as described above, M1/G is temporarily reset to a black level as the voltage Vth, and then a set voltage Vv is inputted thereto. Thus, the error voltage dv(n) for producing a drive current which is indicated by the equation (2) can be set in M1/G. Thus, an injection current into the EL element can be set without being affected by a variation in Vth which is promoted by a TFT process for the transistor M1 in each pixel display circuit 1 of the display panel and a variation in potential of each power source VCC which results from a wiring resistance.

(Current Setting System)

Next, a current setting system will be described using FIG. 6. FIG. 6 is a circuit diagram of a general pixel display circuit using the current setting system.

An image signal current obtained by converting an input image voltage signal into a current signal by a signal supply circuit is inputted to the signal supply line Video. The signal supply line Video is connected with M4/S whose gate electrode is controlled according to a control pulse P2. M4/D is connected with M2/D whose source electrode is connected with the power source VCC and M3/S whose gate electrode is controlled according to a control pulse P1. M2/G is connected with a capacitor C1 whose one end is connected with the power source VCC, M3/D, and M1/G whose source electrode is connected with the power source VCC. M1/D is connected with the current injection terminal of the EL element. The other terminal of the EL element is grounded (GND).

The operation of the pixel display circuit 1 shown in FIG. 6 will be described using time charts in FIGS. 7A to 7E. FIGS. 7A to 7E show the current image signal, the control pulse P1, the control pulse P2, and a voltage of M1/G, respectively, which are supplied to the signal supply line Video.

(Before Time t0)

A current on the signal supply line Video becomes a set current Id(n−1) into the pixel display circuits 1 located on a preceding line. In addition, because P1=H and P2=L, M3 becomes an OFF state and M4 becomes an OFF state. A voltage Vd#(n) determined by the previous light emission setting operation is applied from the power source VCC to M1/G. Thus, an output current from M1 which is determined according to Vd#(n) is injected into the corresponding EL element, so that the EL element emits light.

(At Time t0)

A current on the signal supply line Video is changed into a current Id(n) for setting light emission of the corresponding pixel display circuit 1 shown in FIG. 6. In addition, because P1=L and P2=H, M3 is changed into an ON state and M4 is changed into an ON state. Thus, the current Id(n) supplied to the signal supply line Video is supplied to M2. In M2, a voltage of M2/G is changed so as to satisfy the equation (1), thereby charging the capacitor C1. Therefore, as shown in FIG. 7D, a change in which M1/G connected with M2/G turns from the voltage Vd#(n) to the voltage Vd(n) is started and then finished before the time t1.

(At Time t1)

Because P1=H, M3 is changed into an OFF state, so that the charging operation of the capacitor C1 is stopped. Thus, M1/G is kept to the voltage Vd(n) and becomes a holding state.

(At Time t2)

Because P2=L, M4 is changed into an OFF state, thereby stopping current supply to the transistor M2. Thus, according to an output current from M2 which is produced by the voltage Vd(n) applied to M2/G, a potential of M2/D is rapidly raised, so that it becomes the voltage of the power source VCC. At this time, because M2 becomes a resistor operating region, an output current from M2 is stopped, so that M2 is stabilized in that state. At this time, a change in voltage of M1/G is not caused to keep the voltage Vd(n). Thus, until the next light emission setting operation, the output current from the transistor M1 which is determined according to the voltage Vd(n) is injected into the EL element, light emission in this condition is continued.

(After Time t2)

A current on the signal supply line Video is changed into a set current Id(n+1) for setting light emission of the pixel display circuits 1 located on the next row. In addition, in the corresponding pixel display circuit 1, P1=H and P2=L are kept and the current is not changed until the next light emission setting operation. Then, the light emission setting operation for the pixel display circuits 1 located on the next row is similarly started.

Even in the current setting system as described above, when a display panel is, for example, QVGA (320×240), the signal supply line Video is led to and connected with 240 pixel display circuits 1. The control pulses P1 and P2 are led to and connected with 320 pixel display circuits 1. In the case of the current setting system, when drive characteristics of the transistors M1 and M2 in each pixel display circuit 1 can be relatively ensured, an injection current into the EL element can be logically set without being affected by the transition voltage Vth of each transistor and a variation in absolute value of the drive coefficient k in the equation (1). When two transistors are arranged close to each other, it can be realized with relative ease even in a TFT process that the drive characteristics of the transistors M1 and M2 in each pixel display circuit 1 are relatively ensured. Thus, according to the current setting system, the injection current can be basically set within a wide dynamic range from a small current to a large current, so that a uniformed high quality image can be displayed on the display panel.

However, the voltage drive system shown in FIG. 9 and the current drive system shown in FIG. 6, for driving the EL elements, have the following problems.

(Problems Related to Voltage Drive System in FIG. 9)

Problem 1 (Variation in Drive Coefficient k of Transistor)

As can be understood from the equation (1), the output current Ids of the MOS transistor is determined according to the drive coefficient k varied in each pixel display circuit 1. Thus, it is difficult to obtain uniform light emitting levels of respective pixels in the display panel. In order to obtain uniform light emitting levels, it is necessary to depend on the improvement of a difficult TFT process.

Problem 2 (Keeping of White Balance)

Also, a light emitting current is determined according to the square of the error voltage Δv. Thus, it is difficult to adjust white balance due to balance of light emitting energies of R, G, and B. In addition, because the light emitting current is sensitive to a drift, it is difficult to assure the white balance as the important element of a display image.

Problem 3 (Holding of Reset Period to Voltage Vth)

Further, in order to conduct complete reset operation, a long period is required as a reset operating period (t0 to t1) to Vth of M1/G in the pixel display circuit 1. This is because the self discharging operation of the transistor M1 is weakened as the voltage of M1/G asymptotically approaches Vth. Thus, light emission setting to a minute light emitting region is difficult, it is difficult to ensure a gradation property of the image, and it is difficult to realize a high quality display panel.

(Problem Related to Current Drive System in FIG. 6)

For example, when a size of a QVGA display panel is 2 inches, a maximum desirable injection current into an EL element for each color is a minute current of about 100 nA to 200 nA. In addition, a minimum current of about 1 nA or less is required as a minimum desirable current for ensuring a contrast. Thus, it is necessary to supply a current of from the minute current to the minimum current to the signal supply line Video. Now, when the characteristic equation of the MOS transistor which is indicated by the equation (1) is transformed, it becomes the following equation (3).

$$\left.\begin{aligned} \Delta V &= \sqrt{Ids} \div k \\ \mathrm{re} &= \frac{d\Delta V}{d\,Ids} = \frac{1}{k \times \sqrt{Ids}} \\ \Delta V &= Vgs - Vth \end{aligned}\right] \tag{3}$$

A dynamic resistance re of the transistor M2 in the pixel display circuit 1, by which a potential on the signal supply line Video is determined becomes a very high resistance. In a TFT process according to experiences of the present inventors, re (100 nA)≡1 MΩ and re (1 nA)≡10 MΩ.

Problem 4 (Mixing of Noise into Signal Supplying Line Video)

As described above, the signal supply line Video is led to and connected with a large number of pixel display circuits 1. Thus, a disturbance noise is easily mixed into such a high resistance line. As described above, FIG. 7E shows a state of the voltage of M1/G when a noise is mixed into the signal supply line Video.

During a period except the period of the time t0 to the time t1, M3 is an OFF state. Thus, the signal supply line Video is not connected with M1/G of the corresponding pixel display circuit 1, so that no noise is mixed. However, during the period of the time t0 to the time t1, M3=ON and M4=ON, so that a noise is mixed into M1/G. Therefore, when M3 is changed into an OFF state at the time t1 and the voltage of M1/G is shifted to a holding state, an error of a voltage ΔVd to a desirable value of the voltage Vd(n) when no noise is mixed is caused. Accordingly, an output current shifted from a desirable output current is injected from the transistor M1 into the EL element, so that the amount of light emission is also shifted as a matter of course.

Because a noise cannot be controlled, the shift amount of light emission due to the mixing of noise in each pixel display circuit 1 is changed. Thus, a stable display image cannot be obtained. In addition, when an RGB image signal is small, the influence due to the mixing of noise becomes remarkable. Further, a deterioration in S/N of an image is caused.

The injection current required for the EL element is small. In general, even in a process for a TFT with low drive capacity (small drive coefficient k), a drive error voltage (Vgs−Vth) is about 1/10 of the transition voltage Vth. Thus, a large influence is caused by an error of the voltage of M1/G due to the mixing of noise. Thus, in the current setting system, it is necessary to isolate the display panel from a disturbance noise. However, it is difficult to shield a light emitting surface of the display panel.

Also, in order to suppress a resistance value of the signal supply line Video, it is considered that a size of the transistor M2 in the pixel display circuit 1 is increased to increase the set current Ids, thereby suppressing the dynamic resistance value re of M2. However, even when the set current IDs is increased by ten times, re becomes only $1/\sqrt{10}$ from the equation (3). In addition, according to this method, a large transistor M2 cannot be mounted in the pixel display circuit 1 for a display panel in which a pixel size is limited. In particular, this does not become a solving method for a small size display panel for which the suppression of current consumption is required.

SUMMARY OF THE INVENTION

The present invention has been made in view of the above problems. An object of the present invention is to provide an EL element drive circuit capable of solving the problems and a display panel provided therewith.

According to one aspect of the invention in order to solve the above problems, there is provided an EL element drive circuit for causing an electroluminescence (EL) element which conducts light emitting operation according to an injection current to emit light, including:

the EL element; a first transistor; a second transistor; a third transistor; a capacitor; a first switch; a second switch; a third switch; and a power source, wherein:

a first main electrode of the first transistor is connected with a first main electrode of the second transistor and a gate electrode of the first transistor is connected with a gate electrode of the second transistor;

the capacitor is connected between the first main electrode of the first transistor and the gate electrode thereof;

the EL element is connected with a second main electrode of the first transistor;

the first switch is connected between a second main electrode of the second transistor and the gate electrode thereof;

the second switch is connected between a signal supply line for supplying a signal current defining an injection current into the EL element and the second main electrode of the second transistor;

a first main electrode of the third transistor is connected with the power source, a second main electrode thereof is connected with the first main electrode of the first transistor, and a gate electrode of the third transistor and one of the first main electrode thereof and the second main electrode thereof are short-circuited such that a current flows in a predetermined direction by a potential difference between the first main electrode thereof and the second main electrode thereof;

the third switch is connected between the power source and the first main electrode of the first transistor; and the third switch is opened when the first switch and the second switch are short-circuited, and the third switch is short-circuited when the first switch and the second switch are opened.

According to another aspect of the invention in order to solve the above problems, there is provided a display panel, including a plurality of EL element drive circuits described above which are connected in matrix.

In another aspect of the invention, the EL element drive circuit may further include a pixel display circuit and a signal supply circuit;

the pixel display circuit may include the EL element, the first transistor, the second transistor, the capacitor, the first switch, the second switch, the third switch, and a fourth switch;

the signal supply circuit may include the third transistor;

the pixel display circuit and the signal supply circuit may be connected with each other through a noise reduction line and the signal supply line;

the second main electrode of the third transistor and the first main electrode of the first transistor may be connected with each other through at least the noise reduction line and the fourth switch; and the third switch may be opened and the fourth switch may be short-circuited when the first switch and the second switch are short-circuited, and the third switch may be short-circuited and the fourth switch may be opened when the first switch and the second switch are opened.

According to another aspect of the invention in order to solve the above problems, there is provided a display panel including a plurality of EL element drive circuits each having at least the pixel display circuit and the signal supply circuit, wherein the pixel display circuits are connected in matrix, of the pixel display circuits connected in matrix, pixel display circuits belonging to each line are set at each group, and the pixel display circuits of each group are commonly connected with a signal supply circuit located for each group.

BRIEF DESCRIPTION OF THE DRAWINGS

FIGS. 10A, 10B, 10C, 10D and 10E are time charts for explaining operation of the pixel display circuit shown in FIG. 9.

FIG. 11 is a structural concept view of a TFT process.

DESCRIPTION OF THE PREFERRED EMBODIMENTS (Embodiment 1)

Figure 1:
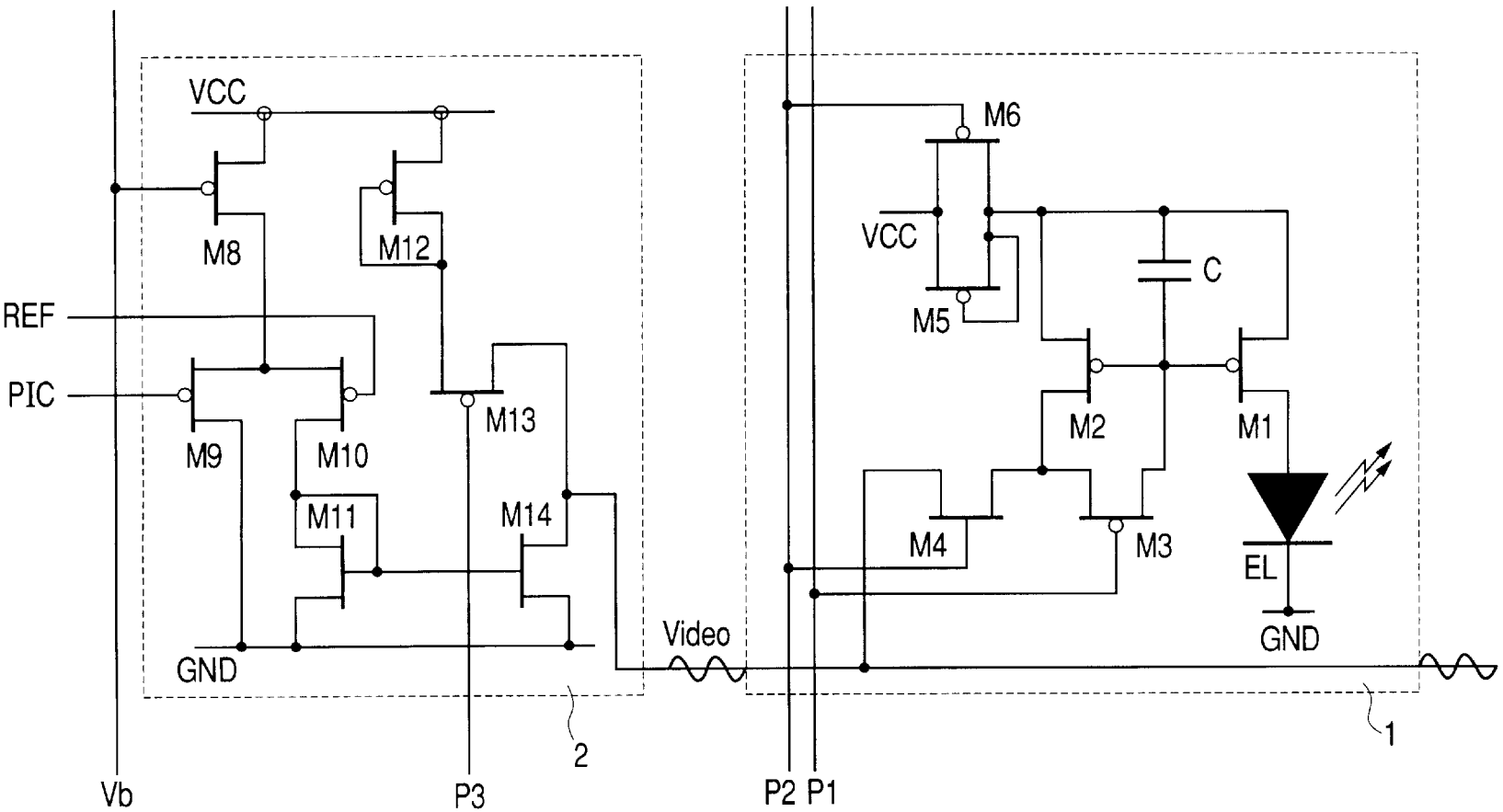
FIG. 1 is a circuit diagram showing an embodiment of an EL element drive circuit of the present invention.

FIG. 1 is a circuit diagram showing Embodiment 1 of an EL element drive circuit of the present invention. In this embodiment, it is constructed that a signal supply circuit 2 for converting an image signal PIC inputted as a voltage into an image current signal is separated from a pixel display circuit 1. A circuit structure of Embodiment 1 of the present invention is included in the pixel display circuit 1. However, the present invention is not limited to such an embodiment.

Here, before the description of the structure shown in FIG. 1, a structural example in the case where a current setting system is used for a display panel will be described.

(Structure of Display Panel using Current Setting System)

Figure 8:
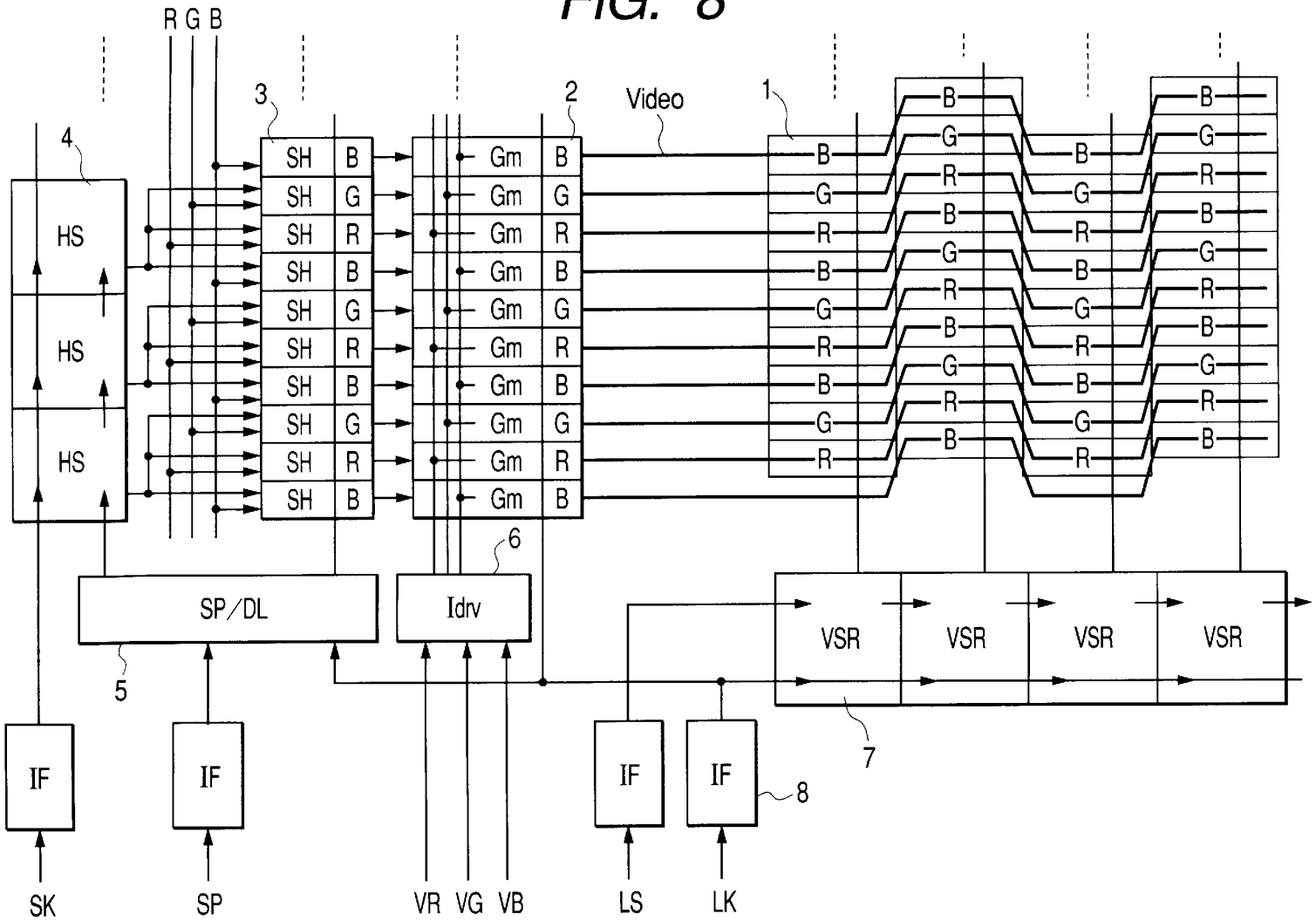
FIG. 8 is a block diagram of the entire display panel using the current setting system.

FIG. 8 is a block diagram of the entire display panel using the current setting system. In FIG. 8, reference numeral 1 denotes the pixel display circuits, 2 denotes the signal supply circuits, 3 denotes sample and hold circuits, 4 denotes horizontal (column) scan shift registers, 5 denotes a pulse generating circuit, 6 denotes a reference current generating circuit, 7 denotes vertical (row) scan shift registers, and 8 denotes an input circuit. In addition, reference symbol Video denotes a signal supply line, SK denotes a pixel clock signal, SP denotes a horizontal (column) start signal, VR, VG, and VB denote reference current setting voltages for respective colors of R, G, and B, and LK denotes a vertical (row) scan clock signal.

An input image voltage signal is an RGB signal and inputted to the respective sample and hold circuits 3 in order to set light emission for each of pixels for R, G, and B. The pixel clock signal SK is inputted to a first horizontal (column) scan shift register 4 through the input circuit 8. The vertical (row) scan clock signal LK is inputted through the input circuit 8 to the pulse generating circuit 5 and a first resistor of the vertical (row) scan shift registers 7 and further inputted to the signal supply circuits 2. The vertical (row) scan clock signal LK is divided into two frequency components by the pulse generating circuit 5 in order to distinguish odd lines and even lines and inputted to the sample and hold circuits 3. The horizontal (column) scan shift registers 4 are each located for respective groups of R, G, and B as shown in the drawing. The horizontal (column) start signal SP is inputted to the pulse generating circuit 5 through the input circuit 8, converted into two horizontal (column) start signals, and inputted to the horizontal (column) scan shift registers 4.

The sample and hold circuit 3 includes two sample and hold circuits in order to treat RGB image voltage signals inputted in succession. When an image signal for an odd line is inputted, a first sample and hold circuit conducts sample operation and a second sample and hold circuit conducts hold operation. When an image signal for an even line is inputted, the second sample and hold circuit conducts sample operation and the first sample and hold circuit conducts hold operation. Thus, the sample and hold circuit 3 is constructed such that RGB image information can be always outputted.

The RGB output image signal PIC from each sample and hold circuit 3 is inputted to each signal supply circuit 2. The RGB reference current setting voltages VR, VG, and VB are inputted to the reference current generating circuit 6. Bias voltages VbR, VbG, and VbB for generating reference currents IoR, IoG, and IoB for respective colors are generated and inputted to the respective signal supply circuits 2 for respective colors. The reference currents IoR, IoG, and IoB are generated by the respective signal supply circuits 2. A reason why the reference current is set for each color as described above is because it is handled that a current light emission converting characteristic of the EL element is generally changed according to respective colors of R, G, and B.

In each signal supply circuit 2, the image signal PIC inputted at a voltage for each color is converted into an image current signal Id related to the reference current generated in the inner portion. The image current signal is supplied to the signal supply line Video which is led to and connected with each of the vertical (row) pixel display circuits 1.

Row control pulses as the outputs to the vertical (row) scan shift registers 7 are supplied to the respective row pixel display circuits 1.

In FIG. 8, the reason why Δ arrangement in which the pixel display circuits 1 for respective colors are shifted by 1.5 pixels between rows is used is because a screen angle for cutting a longitudinal beat of color in a low resolution display panel such as particularly QVGA is formed. In addition, although not shown, the input RGB image signal is generally inputted together with the reference signal in view of noise immunity. At this time, each sample and hold circuit 3 conducts sample and hold operation for the reference signal as in the case of the image signal and outputs it. Thus, the reference signal REF is inputted to each signal supply circuit 2 together with the image signal PIC.

Also, the vertical (row) scan clock signal LK has a function as a blanking signal and is inputted to the signal supply circuit 2 in order to conduct processing during a period for which the outputted current signal Id from the signal supply circuit 2 is not used in the respective column pixel display circuits 1.

(Descriptions of Pixel Display Circuit 1 and Signal Supply Circuit 2 as Shown in FIG. 1)

In FIG. 1, reference numeral 1 denotes the pixel display circuit, 2 denotes the signal supply circuit, reference symbol C denotes a capacitor, EL denotes an EL element, M1 denotes a first transistor, M2 denotes a second transistor, M3 denotes a first switch, M4 denotes a second switch, M5 denotes a third transistor, M6 denotes a third switch, Video denotes the signal supply line, VCC denotes a power source, GND denotes a ground, REF denotes the reference signal, and PIC denotes the image signal.

A first main electrode and a second main electrode in the present invention indicate one of a source electrode and a drain electrode and the other thereof. Hereinafter, an embodiment in which the first main electrode is the source electrode and the second main electrode is the drain electrode will be described. Thus, the embodiment shown in FIG. 1 indicates an example in which respective polarities of MOS transistors are suitably designed and the transistors are wired. Therefore, a structure having the same function as the present invention may be used by changing the polarities of MOS transistors as appropriate. The same holds true of Embodiment 2 described later.

Figure 6:
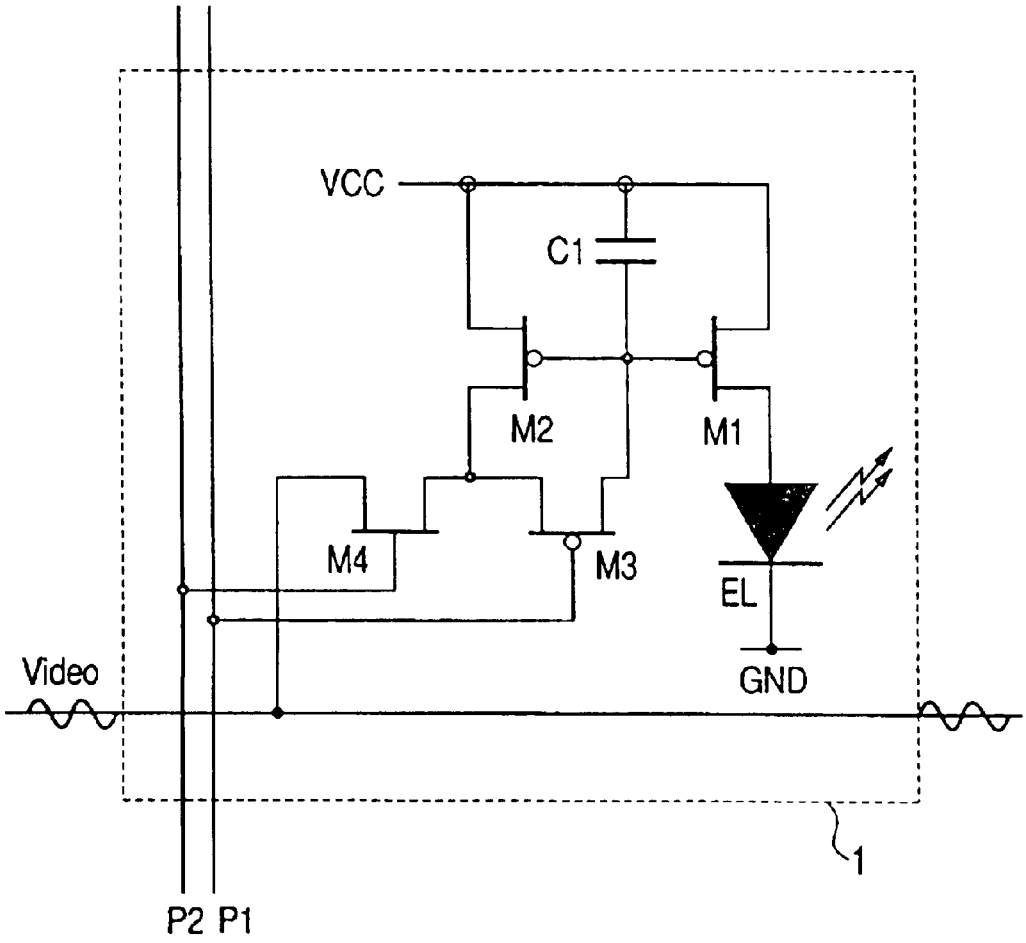
FIG. 6 PRIOR ART
FIG. 6 is a circuit diagram of a general pixel display circuit using a current setting system.
Figures 7A, 7B, 7C, 7D, 7E:
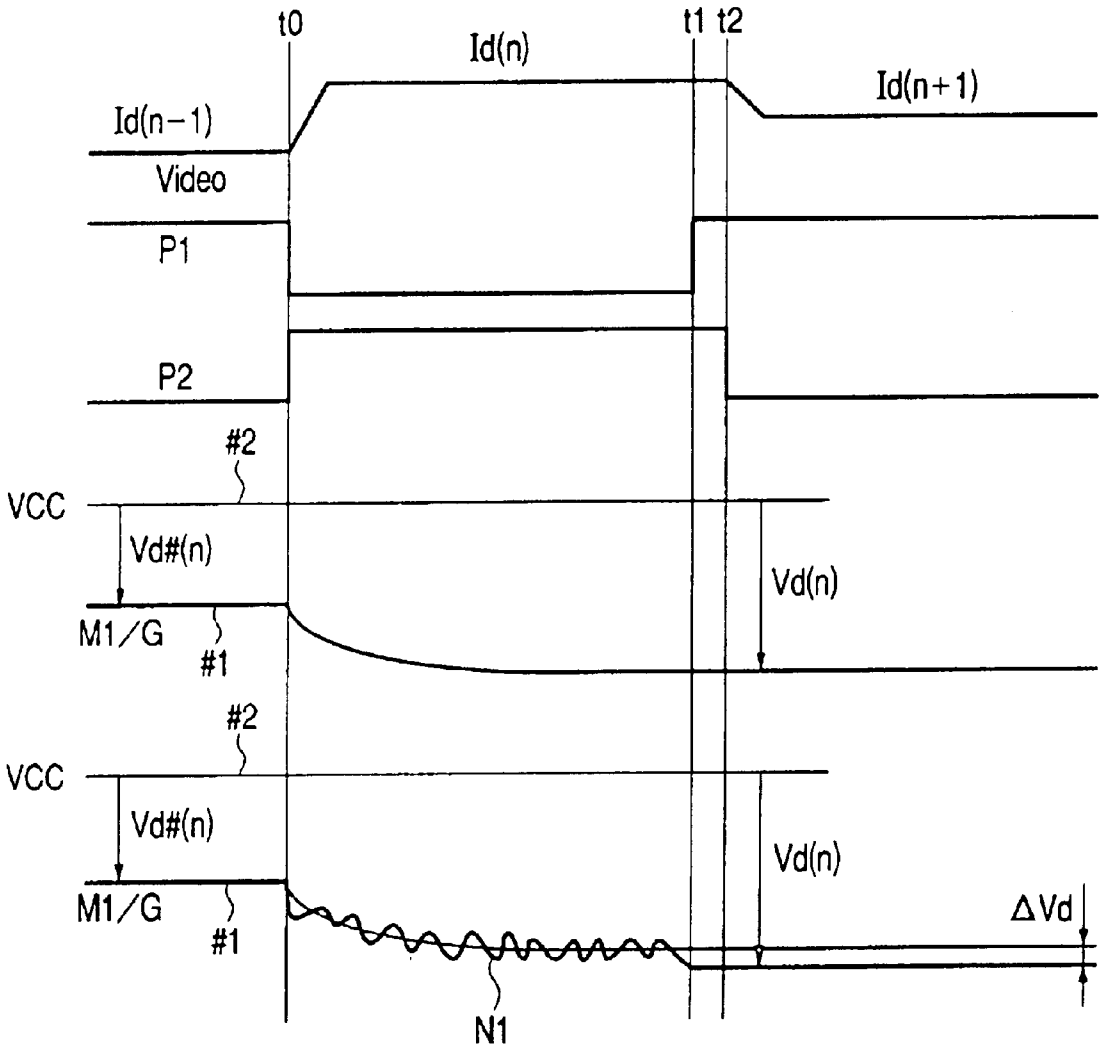
FIG. 7A PRIOR ART
FIG. 7B PRIOR ART
FIG. 7C PRIOR ART
FIG. 7D PRIOR ART
FIG. 7E PRIOR ART
FIGS. 7A, 7B, 7C, 7D and 7E are time charts for explaining operation of the pixel display circuit shown in FIG. 6.

The signal supply circuit 2 shown in FIG. 1 is the same as used for the pixel display circuit 1 of FIG. 6 using the above mentioned current setting system. First, the signal supply circuit 2 will be described.

The image signal PIC and the reference signal REF from the sample and hold circuit 3 are inputted to M9/G and M10/G, respectively, whose source electrodes are connected with each other. A bias voltage Vb is inputted to M8/G whose source electrode is connected with the power source VCC, so that a reference current Io from M8/D is supplied to M9/S (M10/S). M9/D is connected with the ground GND. An image current signal converted with respect to a level difference of the image signal PIC to the reference signal REF and the reference current Io is outputted from M10/D. Thus, as shown in FIG. 1, according to a current mirror circuit composed of transistors M11 and M14, a light emission setting current signal Id from M14/D is outputted to the signal supply line Video.

M14/D is connected with M13/D whose gate is controlled according to a control pulse P3. M13/S is connected with a transistor M12 whose source is connected with the power source VCC and whose drain and gate are short-circuited. The control pulse P3 is a vertical (row) scan clock LK. During a blanking period for which the light emission setting current signal Id outputted to the signal supply line Video is not supplied to the pixel display circuits 1 connected therewith, M13 becomes an ON state. Thus, a potential close to the signal supply line Video which is determined by the pixel display circuit 1 is defined according to the transistor M12.

Next, a different point between the pixel display circuit 1 shown in FIG. 1 and the pixel display circuit 1 shown in FIG. 6 will be described to clear the feature of a structure of the present invention. In other words, according to the structure of the present invention as shown in FIG. 1, the node connected with M1/S, M2/S, and the capacitor C is not directly connected with the power source VCC, but connected with M6/D whose source electrode is connected with the power source VCC and whose gate electrode is controlled according to a control pulse P2, and further connected with a transistor M5 whose source electrode is connected with the power source VCC and whose gate electrode and drain electrode are short-circuited.

When such a structure is used, as is apparent from a later description, it can be prevented that a difference of a potential provided to the capacitor C which results from a noise mixed from the signal supply line video is shifted from a predetermined value.

Figures 3A, 3B, 3C, 3D, 3E, 3F, 3G:
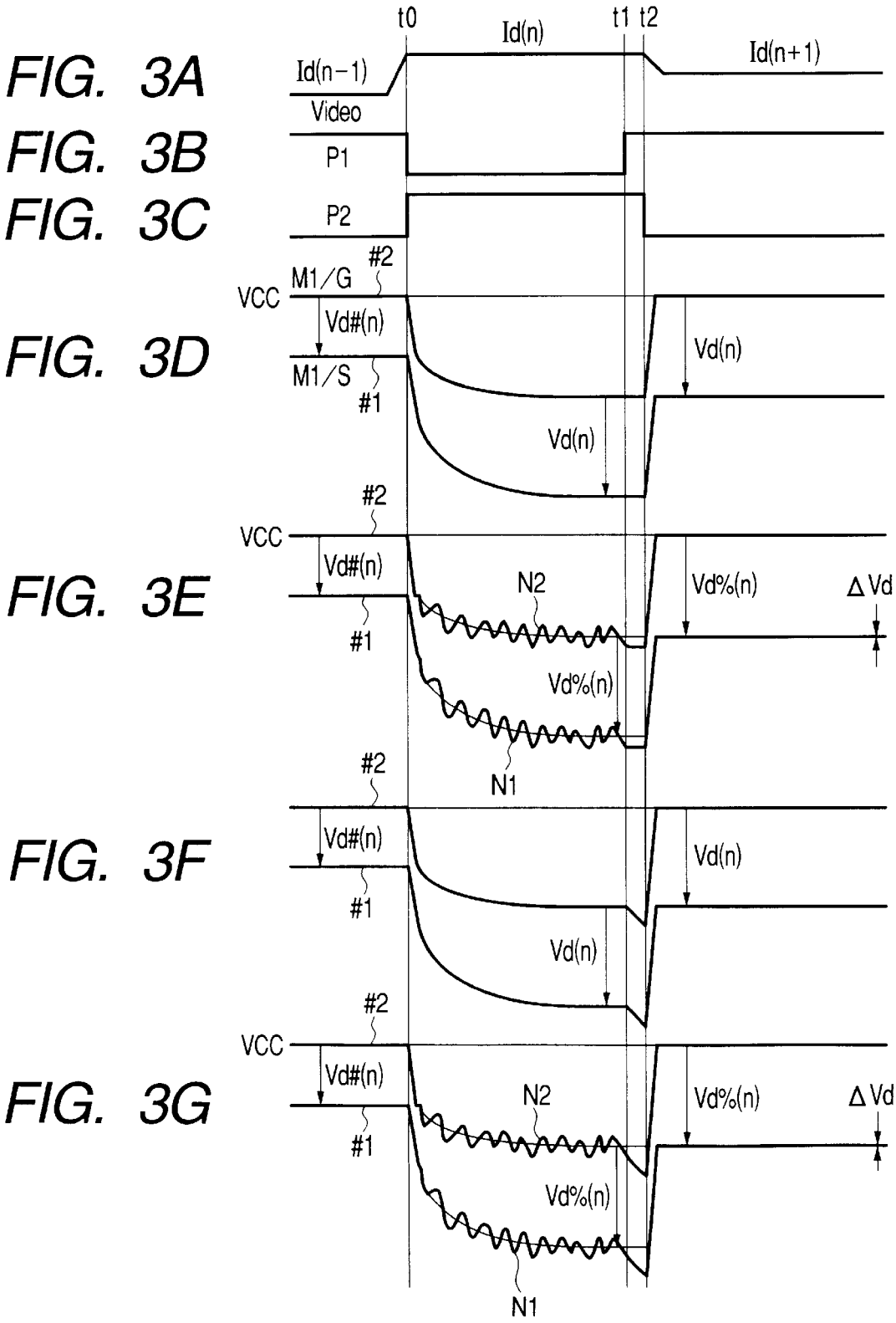
FIGS. 3A, 3B, 3C, 3D, 3E, 3F and 3G are time charts for explaining operation of the EL element drive circuit of the embodiments shown in FIGS. 1 and 2.

The operation of the pixel display panel shown in FIG. 1 will be described using time charts of FIGS. 3A to 3G. FIGS. 3A to 3G show levels of, the light emission setting current signal, the control pulse P1, and the control pulse P2, which are inputted from Video and are the same as the time charts of FIGS. 7A to 7E. In FIG. 3D, #1 and #2 denote a signal of M1/G (M2/G) and a signal of M1/S (M2/S), respectively.

(Before Time t0)

M3 is an OFF state, M4 is an OFF state, and M6 is an ON state. Thus, M2/S (M1/S) becomes a voltage of a power source VCC. Therefore, as in the case of the pixel display circuit 1 shown in FIG. 6, a voltage Vd#(n) is provided to M1/G by the previous current setting, so that an EL element conducts set light emission according to an output current from the transistor M1.

(At Time t0)

M3 is changed into an ON state, M4 is changed into an ON state, and M6 is turned OFF. At this time, the set current Id(n) supplied to the signal supply line Video is supplied to the transistor M5. Thus, M2/S is started to drop a voltage to Vgs of M5 which satisfies the equation (1). In addition to this, because the set current Id(n) is supplied to the transistor M2, M2/G is started to further drop from the voltage of M2/S to Vgs of M2 which satisfies the equation (1). Then, charging operation to the capacitor C using the transistors M5 and M2 is completed before the time t1, so that the voltage of M2/G to that of the M2/S becomes a set voltage Vd(n) for generating the set current in M1 as in the case of the pixel display circuit 1 shown in FIG. 6.

(At Time t1)

M3 is changed into an OFF state. However, the voltage of M1/G (M2/G) to that of M2/S (M1/S) is kept to the set voltage Vd(n).

(At Time t2)

M4 is changed into an OFF state and M6 is changed into an ON state. Thus, M2/S (M1/S) is changed into the voltage of the power source VCC. However, the voltage of M1/G (M2/G) to that of M2/S (M1/S) is kept to the set voltage Vd(n) by the capacitor C. The output current from the transistor M1 is supplied to the EL element, so that the set light emitting operation is conducted until the next light emission setting operation is started. Then, the light emission setting operation of the pixel display circuits 1 of the next row is similarly started.

FIG. 3E shows the operation of the pixel display panel 1 shown in FIG. 1 with respect to mixing of noise into the signal supply line Video which is a problem in the current setting system. In the corresponding pixel display panel 1, when a noise is mixed into the signal supply line Video during a period of t0 to t1 for which the transistor M2 is an ON state, a voltage of M2/G and that of M2/S are varied according to a noise signal as indicated by #1 and #2 in FIG. 3E and have similar waveforms to each other. This reason is as follows. That is, because a set current supplied to the signal supply line Video as described above is a current of from the minute current to the minimum current, it is assumed that a dynamic resistance of the transistor M6 is 1 MΩ to 10 MΩ. Thus, in such a high resistance, the capacitor C becomes voltage storing operation to a noise signal varied for a period shorter than the period of t0 to t1, so that a variation N1 in voltage of M2/G and a variation N2 in voltage of M2/S which result from the mixing of noise become substantially equal to each other. Therefore, even if a noise is mixed into the signal supply line Video, the voltage of M2/G to that of the M2/S can be made to a set voltage Vd % (n) substantially equal to the desirable voltage Vd(n). Accordingly, the set voltage Vd % (n) provided to M1/G after the time t1 is substantially equal to the desirable set voltage Vd(n), so that the EL element which emits light according to the output current from the transistor M1 can conduct substantially desirable light emitting operation.

Note that each of the transistors M3, M4, and M5 in the pixel display circuit 1 shown in FIG. 1 is not limited to one of a P-type and an N-type. It is apparent that the transistors M3 and M4 can be easily constructed by changing the polarities of the control pulses P1 and P2.

(Embodiment 2)

Figure 2:
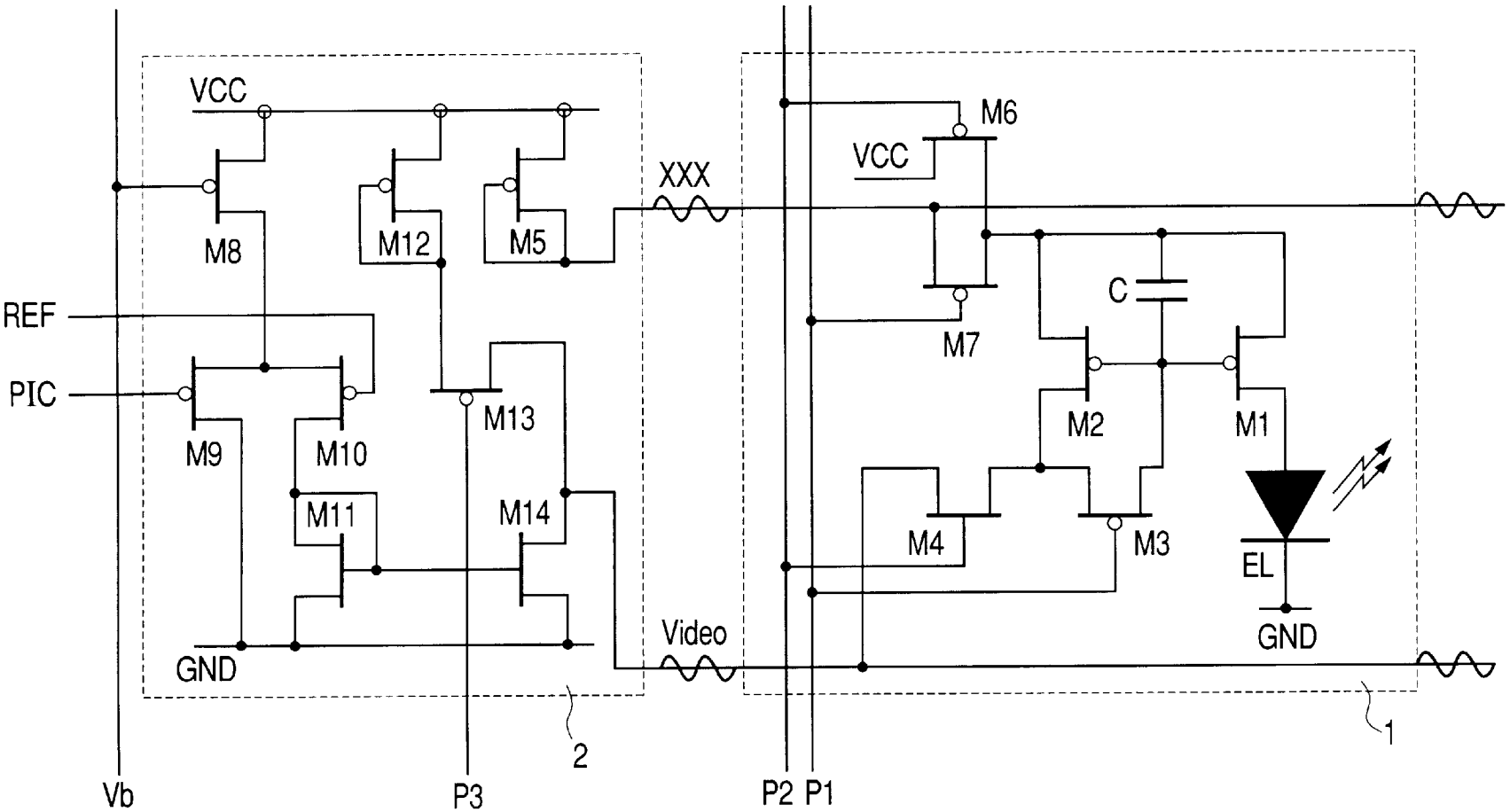
FIG. 2 is a circuit diagram showing another embodiment of an EL element drive circuit of the present invention.

FIG. 2 is a circuit diagram showing Embodiment 2 of an EL element drive circuit of the present invention. In FIG. 2, the same reference symbols as in FIG. 1 indicate the same elements. In addition, M7 denotes a fourth switch.

First, a structural difference between this embodiment shown in FIG. 2 and the above embodiment shown in FIG. 1 with respect to a pixel display circuit 1 and a signal supply circuit 2 will be described.

The pixel display circuit 1 and the signal supply circuit 2 are connected with each other through a noise reduction line xxx in addition to a signal supply line Video. The noise reduction line xxx is led to and connected with the pixel display circuits 1 of the corresponding column as in the case of the signal supply line Video.

In the pixel display circuit 1 shown in FIG. 2, a node connected with M2/S, M1/S, and a capacitor C is connected with the drain electrode of a fourth switch M7 whose source electrode is connected with the noise reduction line xxx and whose gate electrode is controlled according to a control pulse P1.

Also, in this embodiment, a third transistor M5 is included in the signal supply circuit 2.

Next, the operation will be described using the time chart of FIG. 3F.

(Before Time t0)

M3 is an OFF state, M4 is an OFF state, M7 is an OFF state, and M6 is an ON state. Thus, M2/S (M1/S) becomes a voltage of a power source VCC. Therefore, as in the case of the pixel display circuit 1 shown in FIG. 6, a voltage Vd#(n) is provided to M1/G by the previous current setting, so that an EL element conducts set light emission according to an output current from the transistor M1.

(At Time t0)

M3 is changed into an ON state, M4 is changed into an ON state, M6 is changed into an OFF state, and M7 becomes an ON state. At this time, the set current Id(n) supplied to the signal supply line Video is supplied to the transistor M5 in the signal supply circuit 2 through the noise reduction line xxx. Thus, M2/S is started to drop a voltage to Vgs of M5 which satisfies the equation (1). In addition to this, because the set current Id(n) is supplied to the transistor M2, M2/G is started to drop from the voltage of M2/S to Vgs of M2 which satisfies the equation (1). Then, charging operation to the capacitor C using the transistors M5 and M2 is completed before the time t1, so that the voltage of M2/G to that of the M2/S becomes a set voltage Vd(n) for generating the set current in M1 as in the case of the pixel display circuit 1 shown in FIG. 6.

(At Time t1)

M3 is changed into an OFF state and M7 is changed into an OFF state. Thus, the noise reduction line xxx is separated from the corresponding pixel display circuit 1 and M2/S is started to drop a voltage according to the set current Id(n) supplied to the signal supply line Video. However, the set current Id(n) is a current of from the minute current to the minimum current. Therefore, the voltage drop is not rapid, so that the voltage of M1/G (M2/G) to that of M1/S (M2/S) is kept to the set voltage Vd(n).

(At Time t2)

M4 is changed into an OFF state and M6 is changed into an ON state. Thus, the voltage drop of M1/S (M2/S) from the time t1 is stopped and M1/S (M2/S) rapidly becomes the voltage of the power source VCC. During this process, the voltage of M1/G (M2/G) is kept at the voltage of the power source VCC to the set voltage Vd(n) by the capacitor C. The output current from the transistor M1 is supplied to the EL element, so that the set light emitting operation is conducted until the next light emission setting operation is started. Then, the light emission setting operation of the pixel display circuits 1 of the next row is similarly started.

According to this embodiment, because the noise reduction line xxx is led as in the case of the signal supply line Video, a variation N1 in voltage of M2/G and a variation N2 in voltage of M2/S which are resulted from the mixing of noise each become a further similar waveform as compared with the case of the operation of the pixel display circuit 1 in Embodiment 1. Thus, a higher noise reduction effect is obtained. In addition, even in the case of a variation in noise with a longer period than the period of t0 to t1, the voltage of M2/G to that of the M2/S can be made to Vd % (n) substantially equal to the set voltage. Accordingly, the set voltage Vd % (n) provided to M1/G after the time t2 is substantially equal to the desirable set voltage Vd(n), so that the EL element which emits light according to the output current from the transistor M1 can conduct substantially desirable light emitting operation. Note that FIG. 3G clearly shows that the same effect as in Embodiment 1 shown in FIG. 3E is obtained also in this embodiment.

Also in this embodiment, each of the transistors M3, M4, and M7 in the pixel display circuit 1 shown in FIG. 2 are not limited to one of a P-type and an N-type. It is apparent that the transistors can be easily constructed by inputting gate control pulse signals to the respective transistors as appropriate.

Figure 4:
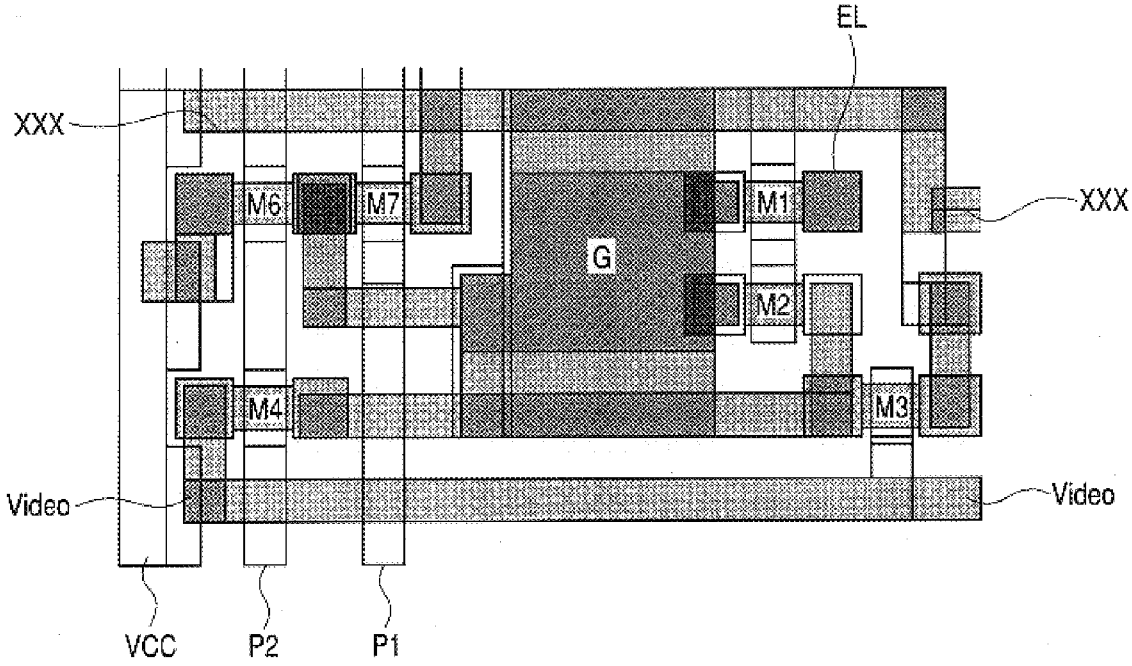
FIG. 4 shows an example of a circuit layout of a pixel display circuit included in the EL element drive circuit of the embodiment shown in FIG. 2.

As described above, a limitation in space of the pixel display circuit 1 of the display panel is very large. FIG. 4 shows an example of a layout structure assuming a TFT process with respect to the pixel display circuit 1 shown in FIG. 2. In addition, FIG. 11 is a concept view of a structure of the TFT process used in that case.

According to the structure, a gate wiring layer b which can be also used for another wiring is provided on a glass substrate a. A gate oxide film layer c as a thin insulating layer is provided on the gate wiring layer b, a polysilicon layer d is provided thereon, and a first wiring insulating layer e is provided thereon. Through holes are provided in connection locations of the first wiring insulating layer e, a first wiring layer f is provided thereon, a relatively thick second wiring insulating layer g is provided thereon, and then its surface is flattened. A through hole is provided in a node location connected with a current injection terminal of the EL element. Then, a second wiring layer h is provided in a light emitting region of the corresponding EL element, an EL light emitting layer i is provided thereon, and then a transparent conductor (ITO) layer j is provided on the entire surface.

A transistor formed in a region of the polysilicon layer d shown in FIG. 11 indicates the transistor M1 for driving the EL element.

The TFT process described above is generally called a bottom gate method. There is a limitation to a wiring usage condition of the gate wiring layer b. However, it will be preferable to a transistor characteristic.

In the layout of the pixel display circuit 1 shown in FIG. 4 which is constructed by the TFT process shown in FIG. 11, the gate wiring layer b is used for a line of the power source VCC, a line of the control pulse P1, and a line of the control pulse P2 which become row wirings of the display panel. The first wiring layer f is used for the signal supply line Video and the noise reduction line xxx which become column wirings. The capacitor C is composed of the gate wiring layer b, the gate oxide film layer c, and the polysilicon layer d. Note that, in FIG. 4, a node M1/D indicated by EL is a connection pad with a current injection terminal of the EL element. The second wiring layer h, the EL light emitting layer i, and the transparent conductor layer j are omitted in FIG. 4.

Figure 5:
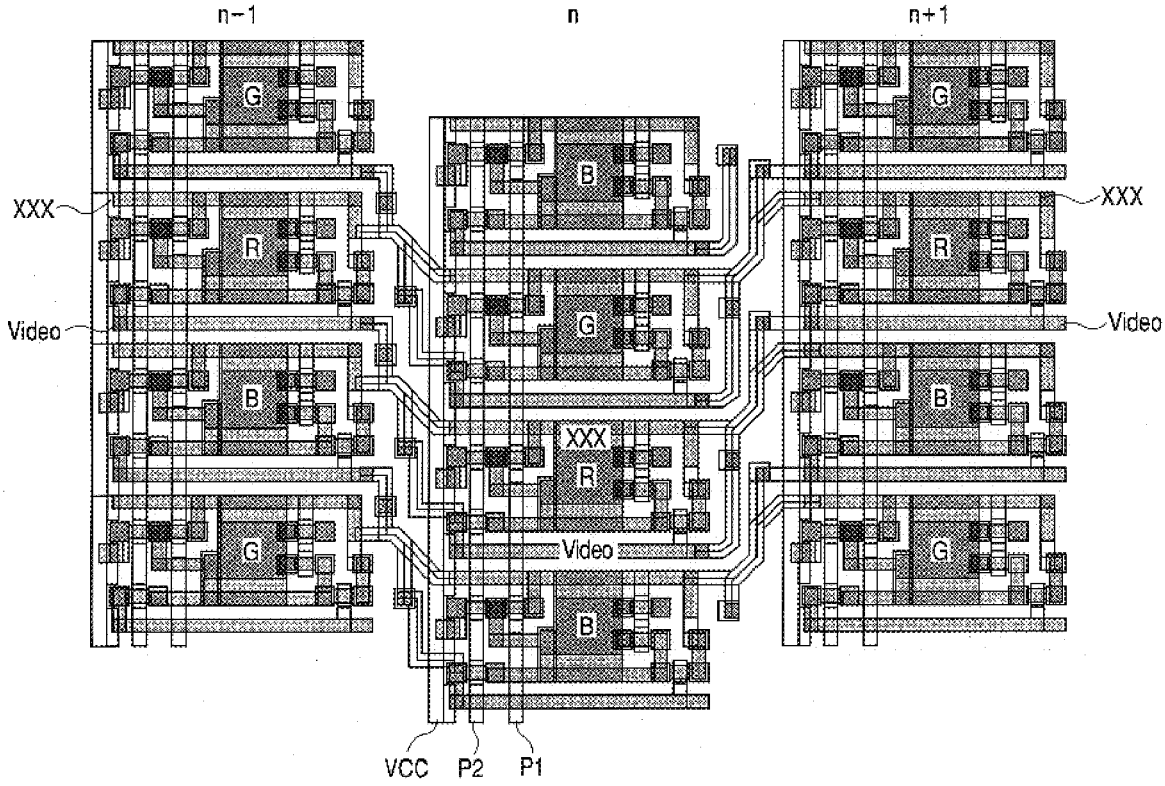
FIG. 5 shows a circuit layout of a display panel of a type in which a plurality of pixel display circuits each having the circuit layout of the embodiment shown in FIG. 4 are arranged in a Δ shape.

As described above, it is very important to use Δ arrangement for the pixel display circuits 1 in the display panel. FIG. 5 shows a Δ arrangement layout realized using the layout of the pixel display circuits 1 shown in FIG. 4.

With respect to the Δ arrangement layout, a limitation to the number of column wirings is large. However, unlike the case of the signal supply line Video, because the signal supply circuit 2 connected with the noise reduction line xxx in the pixel display circuit 1 shown in FIG. 2 is preferably connected with the signal supply circuit 2 for any color, the limitation to the number of column wirings can be reduced. For example, in FIG. 5, the noise reduction lines xxx for R-color are connected with each other through the noise reduction line xxx in the pixel display circuit 1 for B-color of the most adjacent row.

Figure 9:
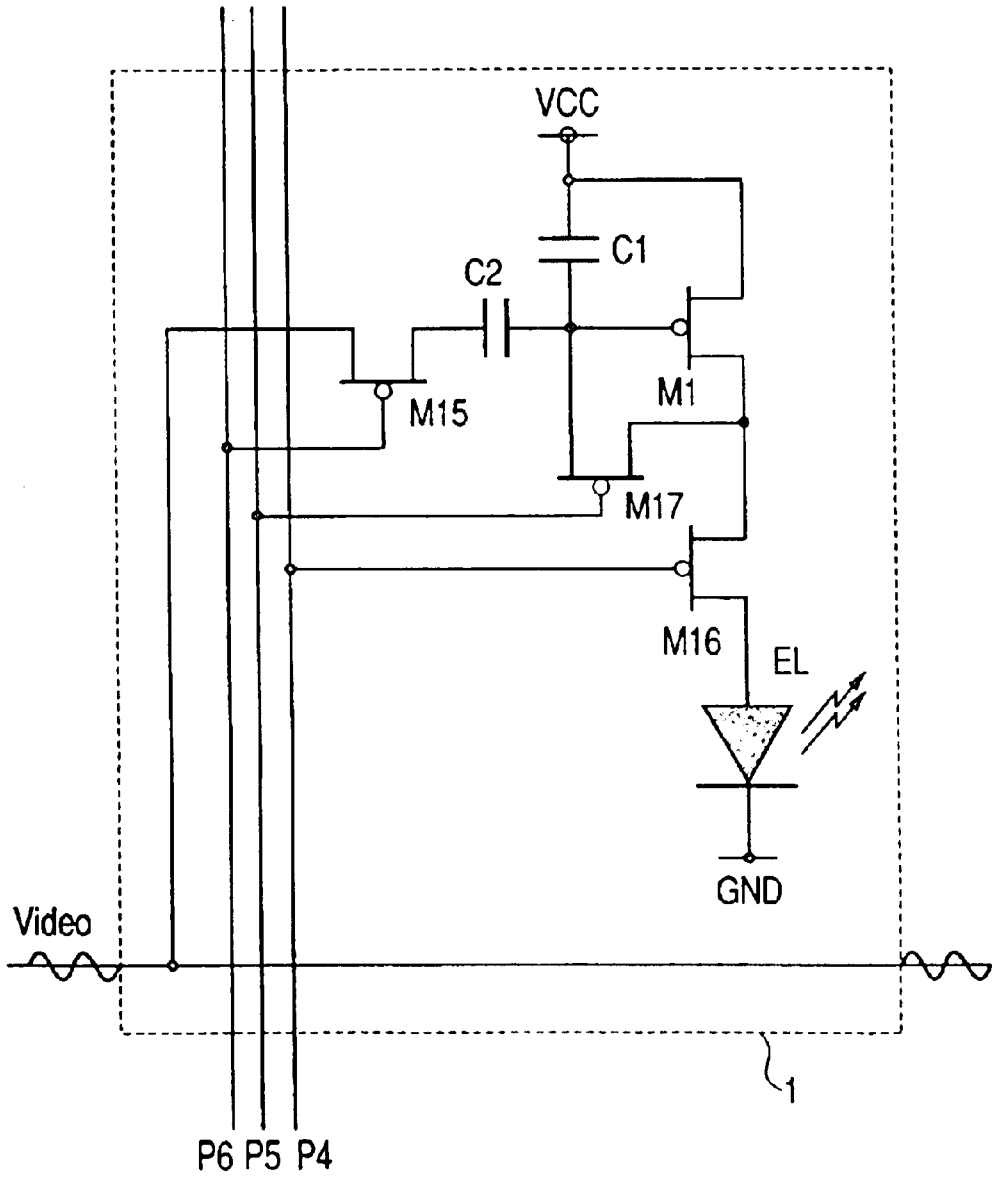
FIG. 9 PRIOR ART
FIG. 9 is a circuit diagram of a general pixel display circuit using a voltage setting system.

The number of transistors to be used in the pixel display circuit 1 shown in FIG. 2 is 6. In addition, the number of transistors to be used for the current setting system shown in FIG. 6 and the voltage setting system shown in FIG. 9 is 4. Thus, the former is larger than the latter by two. However, the capacitor C2 is required in the case of the voltage setting system and becomes larger than the transistor. In addition, in order to improve the noise immunity even in the current setting system shown in FIG. 6, the transistor M2 shown in FIG. 6 is made large to increase the set current supplied to the signal supply line Video. Therefore, with respect to the layout, the two EL element drive circuits in which the number of transistors is 4 have no advantage.

Further, with respect to the layout of the pixel display circuits 1 in the Δ arrangement shown in FIG. 5, 190 ppi in a column direction and 200 ppi in a row direction can be realized by a TFT process of a 4$\mu$ rule which is in the actual use. The realization possibility of 200 ppi as a target in a column direction is extremely high according to miniaturization by a TFT process which is rapidly progressed.

As described above using the respective embodiments, when the EL element drive circuit of the present invention is used, light emitting operation can be conducted for the EL element without being affected by variations in characteristics of circuit elements to be used, as compared with the general voltage setting system. In addition, light emission operating errors (variations) of the EL elements which result from mixing of a noise into the signal supply line are markedly reduced as compared with the general current setting system. Further, a limitation of drive circuit layout can be minimized. Consequently, there is an effect that a high quality display panel using EL elements can be realized.

What is claimed is:

1. An EL element drive circuit for causing an electroluminescence (EL) element which conducts light emitting operation according to an injection current to emit light, comprising:

the EL element; a first transistor; a second transistor; a third transistor; a capacitor; a first switch; a second switch; a third switch; and a power source, wherein:

a first main electrode of the first transistor is connected with a first main electrode of the second transistor and a gate electrode of the first transistor is connected with a gate electrode of the second transistor;

the capacitor is connected between the first main electrode of the first transistor and the gate electrode thereof;

the EL element is connected with a second main electrode of the first transistor;

the first switch is connected between a second main electrode of the second transistor and the gate electrode thereof;

the second switch is connected between a signal supply line for supplying a signal current defining an injection current into the EL element and the second main electrode of the second transistor;

a first main electrode of the third transistor is connected with the power source, a second main electrode thereof is connected with the first main electrode of the first transistor, and a gate electrode of the third transistor and one of the first main electrode thereof and the second main electrode thereof are short-circuited such that a current flows in a predetermined direction by a potential difference between the first main electrode thereof and the second main electrode thereof;

the third switch is connected between the power source and the first main electrode of the first transistor; and the third switch is opened when the first switch and the second switch are short-circuited, and the third switch is short-circuited when the first switch and the second switch are opened.

2. A display panel comprises a plurality of electroluminescence (EL) element drive circuits connected in matrix, wherein each EL element drive circuit causing an EL element which conducts light emitting operation according to an injection current to emit light, the EL element drive circuit comprising:

the EL element; a first transistor; a second transistor; a third transistor; a capacitor; a first switch; a second switch; a third switch and a power source, wherein:

a first main electrode of the first transistor is connected with a first main electrode of the second transistor and a gate electrode of the first transistor is connected with a gate electrode of the second transistor;

the capacitor is connected between the first main electrode of the first transistor and the gate electrode thereof;

the EL element is connected with a second main electrode of the first transistor;

the first switch is connected between a second main electrode of the second transistor and the gate electrode thereof;

the second switch is connected between a signal supply line for supplying a signal current defining an injection current into the EL element and the second main electrode of the second transistor;

a first main electrode of the third transistor is connected with the power source, a second main electrode thereof is connected with the first main electrode of the first transistor, and a gate electrode of the third transistor and one of the first main electrode thereof and the and the second main electrode thereof are short-circuited such that a current flows in a predetermined direction by a potential difference between the first main electrode thereof and the second main electrode thereof;

the third switch is connected between the power source and the first main electrode of the first transistor; and the third switch is opened when the first switch and the second switch are short-circuited, and the third switch is short-circuited when the first switch and the second switch are opened.

3. The EL element drive circuit according to claim 1, further comprising a pixel display circuit and a signal supply circuit, wherein:

the pixel display circuit includes the EL element, the first transistor, the second transistor, the capacitor, the first switch, the second switch, the third switch, and a fourth switch;

the signal supply circuit includes the third transistor;

the pixel display circuit and the signal supply circuit are connected with each other through at least a noise reduction line and the signal supply line;

the second main electrode of the third transistor and the first main electrode of the first transistor are connected with each other through the noise reduction line and the fourth switch; and the third switch is opened and the fourth switch is short-circuited when the first switch and the second switch are short-circuited, and the third switch is short-circuited and the fourth switch is opened when the first switch and the second switch are opened.

4. A display panel comprising a plurality of EL element drive circuits according to claim 3, wherein the pixel display circuits are connected in matrix, of the pixel display circuits connected in matrix, pixel display circuits belonging to each line are set at each group, and the pixel display circuits of each group are commonly connected with a signal supply circuit located for each group.

* * * * *

UNITED STATES PATENT AND TRADEMARK OFFICE

CERTIFICATE OF CORRECTION

PATENT NO. : 6,737,813 B2
DATED : May 18, 2004
INVENTOR(S) : Somei Kawasaki et al.

It is certified that error appears in the above-identified patent and that said Letters Patent is hereby corrected as shown below:

Column 1,
Line 35, “respectively)” should read -- respectively). --.

Column 15,
Line 6, “and the” (second occurrence) should be deleted.

Signed and Sealed this

Fourteenth Day of December, 2004

JON W. DUDAS
*Director of the United States Patent and Trademark Office*